US005869144A

United States Patent [19]

Stavros

[11] Patent Number: 5,869,144

[45] Date of Patent: Feb. 9, 1999

[54] BORON NITRIDE-SILICATE SEALANT

[75] Inventor: Anthony John Stavros, Carmel, Ind.

[73] Assignee: Praxair S.T. Technology, Inc., Danbury, Conn.

[21] Appl. No.: 789,037

[22] Filed: Jan. 27, 1997

Related U.S. Application Data

[63] Continuation of Ser. No. 641,673, May 1, 1996, abandoned, which is a continuation of Ser. No. 249,767, May 26, 1994, abandoned.

[51] Int. Cl.[6] ..... B05A 3/02

[52] U.S. Cl. ..... 427/376.2; 427/397.8

[58] Field of Search ..... 427/376.2, 397.8

[56] References Cited

U.S. PATENT DOCUMENTS

| | | | |
|---|---|---|---|
| 4,039,337 | 8/1977 | Brown et al. | 106/38.28 |
| 4,274,857 | 6/1981 | Wolfe | 65/26 |
| 4,810,300 | 3/1989 | Holcombe, Jr. et al. | 106/70 |
| 5,067,999 | 11/1991 | Streckert et al. | 156/89 |

*Primary Examiner*—Benjamin Utech
*Attorney, Agent, or Firm*—Robert J. Feltovic

[57] ABSTRACT

A boron-nitride-silicate-containing sealant having good resistance to attack by molten metal such as molten zinc and a method for coating the sealant on a substrate.

8 Claims, No Drawings

BORON NITRIDE-SILICATE SEALANT

This application is a Continuation of prior U.S. application: Ser. No. 08/641,673 Filing Date May 1, 1996, now abandoned, which is a continuation of application Ser. No. 08/249,767 Filing Date: May 26, 1994, now abandoned.

FIELD OF THE INVENTION

The invention relates to a boron nitride-silicate sealant having excellent resistance to molten metal, specially molten zinc, and the sealant preferably applied to a component which contacts or is immersed in molten zinc in a hot-dip zinc plating line.

BACKGROUND OF THE INVENTION

Molten zinc attacks metals such as steel and the like and easily penetrates into small holes or gaps in the micrometer range because of its low surface tension and viscosity. Some protecting methods are proposed or are in use for improving the resistance to molten zinc, as for example, specially developed steels as disclosed in Laid Open Japanese Patent Application No. S56-112117 and applying a thermally sprayed WC-Co coating as disclosed in Japan Patent Application Laid Open No. 111-225761. However, these approaches are not sufficiently resistant to molten zinc attack.

Molten zinc resistant steels are basically iron base alloys and do not have enough resistance to molten zinc attack. The cost of those alloys are much higher than normal structural steels. Coatings such as self fluxing alloys and WC-Co are used as thermally sprayed coatings to protect substrates from attack by molten zinc, but sufficient resistance has not been achieved due to the permeation of molten zinc through interconnected porosity and selective attack on the metal binders.

Some sealants that provide protection for rolls used in zinc pots on galvanizing lines, have a tendency to accumulate oxides, dross and the like on the surface of such rolls during operation. The buildup of these oxides, dross and the like could mark steel strip passing over the rolls thus resulting in poor quality steel products.

It is an object of the present invention to provide a boron nitride and silicate sealant for articles, such as rolls that are intended to come into contact with or be immersed in a molten metal, to provide resistance to molten metal attack and minimize buildup of oxides, dross and the like on the surface of such articles. As used herein dross means an intermetallic alloy or compound of, but not limited to aluminum, zinc, iron and combinations thereof.

Another object of the present invention is to provide a boron nitride-silicate sealant that is easy to apply and cost effective to produce.

SUMMARY OF THE INVENTION

The invention relates to a sealing material having an improved resistance to molten metal attack, such as molten zinc, and anti-wettability thus making it ideally suitable for coating structural materials, such as rolls, that are intended to be used in or in contact with molten zinc, aluminum, or zinc-aluminum alloys.

The invention relates to a sealing material having an improved resistance to molten zinc attack and being anti-wettability thus making it ideally suitable for structural materials or thermally sprayed coating that are intended to be used on or in contact with molten metals.

A suitable sealant of this invention which showed excellent durability in molten zinc bath is formed by a process comprising the following steps:

(a) preparing a water solution containing boron nitride and silicate;

(b) applying the solution on the surface of an article to be sealed; and (c) heating the coated article in an appropriate temperature range to substantially remove the water from the coating.

Accordingly, the present invention is to provide firstly a sealant having an excellent resistance to molten metal, specially to molten zinc, and secondly a sealant that will minimize buildup of oxides, dross and the like when used in contact with a molten metal such as zinc. The sealant comprises an aqueous solution of boron nitride and silicate which can be applied to the surface of an article by painting, spraying, such as thermal spraying, or using any other conventional technique. Preferably, the aqueous sealant solution could contain 6 to 18 weight percent boron nitride solids (BN), 9 to 26 percent silicide solids (total metal oxides+silica) and the balance water. More preferably, the aqueous sealant solution could contain 9 to 15 weight percent boron nitride solids, 13 to 24 weight percent silicide solids and the balance water, with the most preferred being from 10.5 to 13.5 weight percent boron nitride solids, from 17 to 20 percent silicate solids and the balance water. After applying the aqueous solution to an article, it should be dried to remove substantially all of the water. Preferably, the water in the coating should be reduced to 10% or less of the water used in the aqueous solution and preferably reduced to 5% or less of the water used in the aqueous solution. To insure removal of the water, the coated nitride could be heated above 212 °F. for a time period to reduce the water in the coating to 5% or less. Generally, a time period of 1 to 10 hours would be sufficient, with a time period of 4 to 8 hours being preferred. It is preferable to heat the coated article above 212° F., since water in solution can not be effectively vaporized below 212° F. Excessive residual water can result in cracks in the sealant layer when it is rapidly heated up to the molten zinc temperature which is approximately 470° C.

Preferably silicates for use in this invention have the general formula:

$$M_2O.xSiO_2.yH_2O$$

where

M is an alkali metal, x is the number of moles of $SiO_2$ with a range of 1.6 to 4, and y is the number of moles of $H_2O$ with a value of at least 1. Preferably, M would be an element selected from the group consisting of sodium, potassium and lithium.

Suitable silicate solutions would be 26.5 weight percent $SiO_2$, 10.6 weight percent $Na_2O$ with the remainder water; 20.8 weight percent $K_2O$, 8.3 weight percent $SiO_2$ with the remainder water; and 28.7 weight percent $SiO_2$, 8.9 weight percent $Na_2O$ with the remainder water. It is also within the scope of this invention to use two different $M_2O$ components, such as a mixture of $Na_2O$ and $K_2O$.

Once the sealant is deposited on a substrate and the water is substantially removed, it could contain 15 to 70 weight percent boron nitride and 30 to 85 weight percent silicate, preferably 31 to 56 weight percent boron nitride and 44 to 69 weight percent silicate and most preferably 41.5 to 47.5 weight percent boron nitride and 52.5 t 58.5 weight percent silicate. The boron nitride-silicate sealant will resist buildup of oxide and dross of this invention which generally adhere to an article when in contact with a molten metal such as molten zinc. The amount of boron nitride should be sufficient to provide a non-stick surface while the silicate is used to maintain the boron nitride on the surface of an article such as a roll, thus sealing the roll from penetration of molten metal, such as molten zinc. To enhance penetration of the sealant into the pores on the surface of the article, such as a roll, a suitable wetting agent can be added such as various stearates, phosphates or common household detergents. Preferably an amount of about 2 weight percent or less would be sufficient for most application. The boron nitride to be used can be highly pure or can be mixed with clays, aluminas, silica and carbon. Thus inexpensive commercial boron nitride can be used in this invention. Generally, rolls intended for use with molten zinc are coated with a protective layer such as tungsten carbide cobalt, alumina, zirconia or molybdenum boride. The sealant of this invention can then be deposited over the coating to prevent penetration of molten zinc to the substrate of the roll and also to minimize buildup of oxides and/or dross on the surface of the coated roll from the molten zinc.

EXAMPLE 1

On a hot dip coating line producing 55% Al—Zn coated steel strip, pot roll failures due to pickup of dross and/or oxides have been reported to occur in as little as 4 to 5 days. A failure refers to deposits on the coated roll which can cause denting or other damage of the steel sheet or other material contacting the roll.

A test was performed in which a 316L stainless steel pot roll was coated with 5 to 7 mils of tungsten carbide cobalt by a detonation gun method. The coating was sealed by two applications of a sodium silicate solution containing boron nitride with a composition as follows.

40 wt/% BN "paint" (more than 30% BN, less than 4% clay and more than 66% $H_2O$)

10 wt/% $H_2O$ 50 wt/% (2.5 ratio $SiO_2/Na_2O$) sodium silicate solution.

After the second application of the sealant on the roll, the roll was baked in air at a temperature slightly over 212 °F. for 6 hours.

The roll performed successfully on a hot dip zinc coating line for 18 days while an uncoated roll would be expected to last only 4 days. Upon removal from the molten 55% Al—Zn bath, dross buildup was found across ¾ of the roll face. This roll was then pickled in dilute $H_2SO_4$ (HCl could also be used) to remove the buildup without damaging the coating and then the coated roll was put back into service.

EXAMPLE 2

All three rolls of a nominally pure zinc galvanizing line coating rig (1 grooved sinker roll and 2 smooth stabilizer rolls) were coated and sealed as described in Example 1. After nine days of service the coating rig was removed for inspection during routine maintenance line shutdown. It was found that the zinc was easily removed from the roll faces by wiping and then the roll was returned to service. After similar service, the roll faces of unsealed rolls would be completely covered with zinc that could not be removed except by mechanical means or pickling.

It is to be understood that modifications and changes to the preferred embodiment of the invention can be made without departing from the spirit and scope of the invention.

What is claimed:

1. A process for sealing an outer porous surface of an article with a boron nitride-silicate-containing sealant comprising the steps:

(a) preparing boron nitride in an aqueous solution of silicate;

(b) applying the solution on the outer porous surface of the article to be sealed; and (c) heating the coated article of step (b) for a time period to substantially remove the water in the sealant coating; and (d) contacting said molten article with molten zinc.

2. The process of claim 1 wherein in step (c) the coated article is heated at a temperature of 212 °F. or above.

3. The process of claim 1 wherein the aqueous solution contains 6 to 18 weight percent boron nitride solids, 9 to 26 percent silicate solids and the balance water.

4. The process of claim 3 wherein in step (a) the boron nitride solids are present in an amount of 9 to 15 weight percent, said silicate solids are present in an amount of 13 to 24 weight percent, and said water is the balance.

5. The process of claim 1 wherein the silicate has the formula:

$$M_2O.xSiO_2.yH_2O$$

where

M is an alkali metal, x is the number of moles of $SiO_2$ with a range of 1.6 to 4, and y is the number of moles of $H_2O$ with a value of at least 1.

6. The process of claim 5 wherein M is selected from the group consisting of sodium, potassium, and lithium.

7. The process of claim 1 wherein in step (a) the aqueous solution contains, in addition to boron nitride, at least one material selected from the group consisting of clay, aluminas, silicas and carbon.

8. The process of claim 1 wherein a wetting agent selected from the group consisting of searates, phosphates and detergents is added to the sealant solution.

* * * * *